US007614862B2

(12) United States Patent
Van Der Heggen et al.

(10) Patent No.: US 7,614,862 B2
(45) Date of Patent: Nov. 10, 2009

(54) WATER-INJECTED SCREW COMPRESSOR ELEMENT

(75) Inventors: Ann Valerie Van Der Heggen, Kasterlee (BE); Benjamin Moens, Schelle (BE)

(73) Assignee: Atlas Copco Airpower, Naamloze Vennootschap, Wilrijk (BE)

( * ) Notice: Subject to any disclaimer, the term of this patent is extended or adjusted under 35 U.S.C. 154(b) by 0 days.

(21) Appl. No.: 11/884,706

(22) PCT Filed: Feb. 22, 2006

(86) PCT No.: PCT/BE2006/000014

§ 371 (c)(1),
(2), (4) Date: Aug. 20, 2007

(87) PCT Pub. No.: WO2006/089381

PCT Pub. Date: Aug. 31, 2006

(65) Prior Publication Data

US 2008/0260562 A1 Oct. 23, 2008

(30) Foreign Application Priority Data

Feb. 22, 2005 (BE) ..... 2005/0092
Apr. 5, 2005 (BE) ..... 2005/0174

(51) Int. Cl.
*F01C 1/16* (2006.01)

(52) U.S. Cl. ..... 418/201.1; 418/98

(58) Field of Classification Search ..... 418/201.1, 418/DIG. 1, 98; 417/410.4, 410.3
See application file for complete search history.

(56) References Cited

U.S. PATENT DOCUMENTS 3,941,520 A * 3/1976 Olofsson ..... 418/97
4,394,113 A * 7/1983 Bammert ..... 418/98
4,439,121 A * 3/1984 Shaw ..... 418/98
5,167,496 A * 12/1992 Jacobsson et al. ..... 418/201.1
5,253,988 A * 10/1993 Hunziker et al. ..... 418/98
6,095,780 A * 8/2000 Ernens ..... 418/201.1
6,302,667 B1 10/2001 Timuska et al.
6,688,868 B2 2/2004 Segers et al.
7,413,419 B2 * 8/2008 De Smedt et al. ..... 417/410.4
2002/0192096 A1 12/2002 Segers et al.

FOREIGN PATENT DOCUMENTS

BE 1 013 221 11/2001
WO WO 8303641 A1 * 10/1983
WO WO 02070900 A1 * 9/2002

* cited by examiner

*Primary Examiner*—Thomas E. Denion
*Assistant Examiner*—Mary A Davis
(74) *Attorney, Agent, or Firm*—Bacon & Thomas, PLLC

(57) ABSTRACT

Improved water-injected screw compressor element which mainly consists of a housing (2) on the one hand, confining a rotor chamber (5) with an inlet (6) on one far end and an outlet (7) on the other far end and in which two co-operating rotors (3, 4) are provided which are bearing-mounted in the housing (2) with their shaft (16, 20) by means of water-lubricated bearings (17, 18, 21, 22), characterised in that for every rotor are provided two pistons, a first piston (37, 38) and a second piston (17, 21) respectively, which can be each axially shifted in a guide, whereby each of these pistons (17, 21, 37, 38) makes contact with the rotor (3, 4) concerned with one side or is part of it, and makes contact with a pressure chamber (41, 42, 43, 44) with an opposite side, in order to partly or almost entirely compensate for axial force components exerted by the compressed gasses on the rotors.

18 Claims, 4 Drawing Sheets

WATER-INJECTED SCREW COMPRESSOR ELEMENT

The present invention concerns an improved water-injected screw compressor element.

Known water-injected screw compressor elements comprise a housing on the one hand confining a rotor chamber with an inlet on one far end and an outlet on the other far end and in which two co-operating rotors are provided which are bearing-mounted in the housing with their shaft by means of water-lubricated bearings, on the inlet side and on the outlet side of the housing respectively, and a water circuit on the other hand for the injection of water which is taken at the outlet of a compressor element and which opens into the rotor chamber and at the above-mentioned bearings.

With such water-injected compressor elements, water is used as a lubricant instead of oil, for the rotors as well as their bearings.

This makes it possible to obtain oil-free compressed air and to cool the rotors in a simple manner, as a result of which the compression temperature can be kept under control and the efficiency of the compression will be great on the one hand, and to avoid sealing problems occurring if the bearings would be oil-lubricated on the other hand, since water may not penetrate in such bearings and oil may not leak in the compressed air.

These compressor elements contain hydrodynamic slide bearings for the radial positioning and hydrostatic and/or hydrodynamic slide bearings for the axial positioning of the rotors.

The axial slide bearings, to which water is supplied so as to lubricate them, must absorb the axial force exerted on the rotors by the compressed gas.

As the diameters of the axial bearings are restricted by the centre distance between the rotors, the impact of the reactive force which can be generated in the bearing will be determined by the water pressure in the bearing.

In the case of hydrostatic bearings, the feeding pressure, required to absorb the above-mentioned axial force, is larger than the outlet pressure of the compressor element.

These compressor elements thus need an additional pump to increase the feeding pressure of the water for the hydrostatic bearings.

In the case of hydrodynamic axial bearings, the speed must be sufficiently high so as to be able to build up a sufficient hydrodynamic pressure, which makes starting against the pressure impossible on the one hand, and which strongly reduces the speed range and thus the operational range of the compressor on the other hand.

From BE 1.013.221 it is already known to counteract the above-mentioned axial forces, exerted by the compressed gasses on the motors, by providing a pressure chamber inside the housing, opposite the crosscut end on the inlet side of each rotor shaft, in which opens a branch of the above-mentioned water circuit, such that thanks to the pressure of the water in this chamber, an axial force is exerted on the shaft end concerned, which force is opposed to the above-mentioned axial gas forces and neutralizes these gas forces entirely or almost entirely as the water pressure is practically equal to the pressure at the outlet of the compressor element.

A compressor element as described in BE 1.013.221 is very suitable for application in a one-stage compressor or as a low-pressure compressor element in a multi-stage compressor, but it is less suitable to be applied in a high-pressure compressor element in a multi-stage compressor, since the forces which are exerted on the rotors by the compressed gasses in this case are considerably higher than in the case of a low-pressure compressor element.

The axial forces which are exerted on the rotors by the gasses consist of two components, a single component in proportion to the outlet pressure on the one hand and a single component in proportion to the inlet pressure on the other hand. Both components are directed from the outlet side to the inlet side of the compressor element.

In the case of a high-pressure compressor element, the component which is in proportion to the inlet pressure is a component not to be neglected in the axial gas forces.

These gas forces are too great to be absorbed, given the restricted diameters of the axial bearings.

The invention aims a water-lubricated screw compressor element with water-lubricated bearings which does not have the above-mentioned disadvantage and which can thus also be applied as a high-pressure compressor element in a multi-stage compressor without an additional pump being required for the feeding of the hydrostatic bearings or, in the case of hydrodynamic axial bearings, without the operational range of the compressor having to be restricted.

To this end, the invention concerns an improved water-injected screw compressor element which mainly consists of a housing on the one hand, confining a rotor chamber with an inlet on one far end, and an outlet on the, other far end and in which two co-operating rotors are provided which are bearing-mounted in the housing with their shaft by means of water-lubricated bearings, on the inlet side and on the outlet side of the housing respectively, and a water circuit for the injection of water under pressure on the other hand which opens into the rotor chamber and at the above-mentioned bearings, whereby for every rotor are provided two pistons, a first and a second piston respectively, which can be each axially shifted in a guide, whereby each of these pistons makes contact with the rotor concerned with one side or is part of it and makes contact with a pressure chamber with an opposite side, whereby, in order to partly or almost entirely compensate for axial force components exerted by the compressed gasses on the rotors, the first pressure chamber of the first piston is connected, via a branch, to the rotor chamber for feeding this first pressure chamber with water that is branched off from the rotor chamber at a point where the pressure is equal, or practically equal, or in proportion to the pressure at the outlet of the compressor element, whereas the second pressure chamber of the second piston is connected, via a pipe, at a pressure which is equal, or practically equal or in proportion to the pressure at the inlet of the screw compressor element, and which is fed is with water coming from the first pressure chamber via a leakage connection between both pressure chambers.

In such a screw compressor element according to the invention, one piston exerts an axial force on the rotor concerned which is in proportion to the pressure at thee outlet of the screw compressor element and which is directed opposite to the gas forces on the rotor, whereas the other piston exerts an axial force in the same direction on that same rotor, which force is in proportion to the pressure at the inlet of the screw compressor element.

Thanks to an appropriate dimensioning of the pistons and/or by anticipating the pressures which are branched off to the pressure chambers of the pistons, the axial force components which are exerted by the compressed gasses in a high-pressure compressor element on the rotor can in this manner be entirely or almost entirely compensated for, such that the bearings only have to absorb small forces occurring during operational conditions and during transitional states.

By lubricating the hydrodynamic bearings via a separate water circuit which is independent of the feeding of the above-mentioned pressure chambers, it becomes possible to branch off the water flow, which is used to control the above-mentioned pistons in order to compensate for the gas forces on the rotors, directly from the rotor chamber at a point where the pressure has an appropriate value to be used directly as a control pressure.

Thus, additional components to adjust the control pressure are no longer necessary.

Moreover, thanks to the flow direction of the water through the pressure chambers, direct contact between the water lubrication of the hydrodynamic bearings and the water being fed under a relatively high pressure to the first pressure chamber is avoided.

Thus is avoided that air bells which may be present in the water that is branched off from the rotor chamber would flow through the hydrodynamic bearings as well, which would be detrimental to the life of the bearings.

In the pressure chambers is preferably applied a pressure which is branched off directly in the rotor chamber, directly in the vicinity of the inlet and of the outlet of the screw compressor element respectively, and the pipes between the rotor chambers and the pressure chambers are dimensioned such that practically no pressure losses occur in these guides, as a result of which the pressures in these chambers are equal, or almost equal respectively, to the pressures in the inlet, outlet respectively, of the screw compressor element.

In this case, thanks to an appropriate selection of the dimensions of the pistons, the gas forces on the rotors can be neutralized.

As no or practically no pressure drops occur in the pipes branching off the pressure to the pressure chambers, the pressures in the pressure chambers will always be equal to the pressures in the inlet and in the outlet, also in transitional states, so that also in the transitional states the gas forces are always entirely or almost entirely compensated for without any additional measures.

Alternatively, in order to compensate for the gas forces on the rotors of the compressor element, one can also anticipate the pressures in the above-mentioned pressure chambers, whereby one will have to make sure that the pressures in the pressure chambers are in proportion to the pressures at the inlet, the outlet respectively, of the screw compressor element.

A first alternative consists in branching off the pressures for the pressure chambers directly from the inlet and from the outlet and in providing one or several restrictors in the pipes between the pressure chambers and the inlet or outlet.

By applying such restrictors, the pressures in both chambers can be adjusted such that, but for a constant, they are in proportion to the outlet pressure, the inlet pressure respectively.

A second alternative consists in branching off the pressures for the pressure chambers in points in the rotor chamber where a pressure prevails which is in proportion to the pressure in the inlet, to the pressure in the outlet respectively, such that applying restrictors is no longer necessary.

In order to better explain the characteristics of the invention, the following two preferred embodiments of an improved water-injected screw compressor element according to the invention is given as an example only without being limitative in any way, with reference to the accompanying drawings, in which:

FIG. 1 schematically represents a section of a screw compressor element according to the invention;

FIG. 3 represents a variant of FIG. 1;

Figure 1:
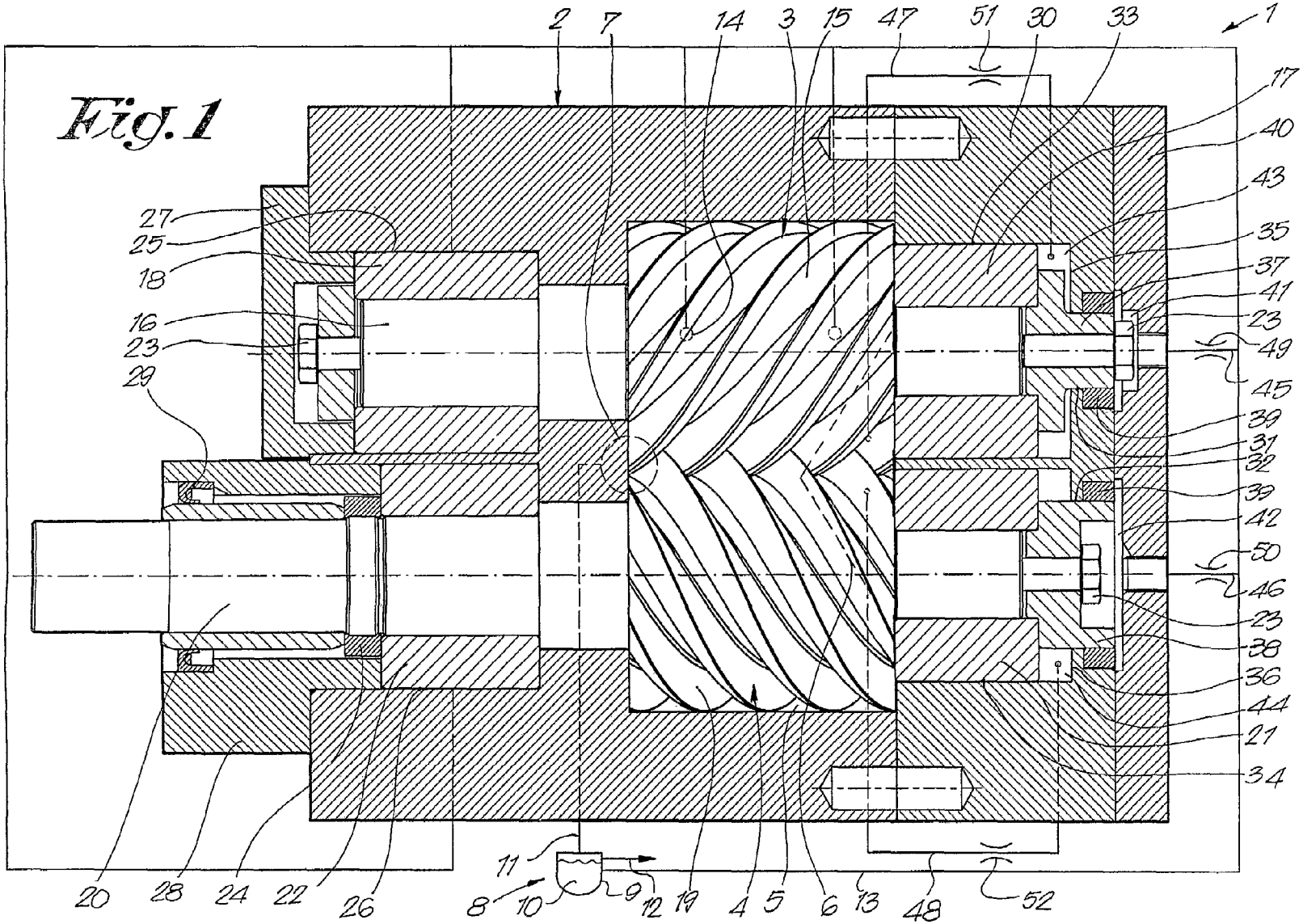

The water-injected screw compressor element 1, as represented in the figures, is a high-pressure compressor element according to the invention which mainly consists of a housing 2 and two co-operating rotors, namely a female rotor 3 and a male rotor 4 which are bearing-mounted in this housing 2.

The housing 2 encloses a rotor chamber 5 which is provided on one far end, called the inlet side, of an inlet 6 for the gas to be compressed and on the other far end, called the outlet side, has an outlet 7 for the compressed gas and the injected water.

The screw compressor element 1 has a water circuit 8 under pressure with a water separator 9 to separate water 10 from the compressed gas, whereby this water separator 9 is connected via an outlet pipe 11 to the outlet 7 and whereby this water separator 9 comprises a discharge pipe 12 at the top for the compressed gas, and comprises a water pipe 13 at the bottom to carry back and inject the water into the rotor chamber 5 via the injection openings 14.

The female rotor 3 has a screw-shaped body 15 provided on a shaft 16, which shaft is bearing-mounted in the housing 2 on either side of the rotor, by means of a water-lubricated radial slide bearing 17 on the inlet side and by means of a water-lubricated combined radial and axial slide bearing 18 on the outlet side respectively.

Naturally, instead of a combined slide bearing 18, also two separate slide bearings in the shape of a radial and an axial slide bearing can be applied.

In an analogous manner, the male rotor 4 has a screw-shaped body 19 and a shaft 20 which is bearing-mounted in the housing by means of water-lubricated slide bearings, a radial slide bearing 21 and a combined or a split radial and axial slide bearing 22 respectively.

The shaft 20 of the male rotor 19 is extended to outside the housing 2, where it can be coupled to a drive which is not represented in the figures.

The bearings 17, 18, 21, 22 are ring-shaped bearings which are provided concentrically round the shaft 16, 20 and which are axially clamped to the rotors 3 and 4, in is this case by means of a bolt 23 and a retaining ring or a nut 24, such that these bearings so to say form part of the rotor 3,4 concerned and thus rotate along with it.

The bearings 18 and 22 on the outlet side are each provided in a bore 25 and 26 provided in the housing 2 and covered with a lid, 27 and 28 respectively, whereby the shaft 20 protrudes through an opening in the lid 28 and is provided with a sealing 29 between the shaft 20 and the lid 28.

On the inlet side, the bearings 17 and 21 are provided in a bearing plate 30 which is part of the housing and which seals the rotor chamber 5, whereby in this bearing plate 30, in the extension of each rotor 3, 4, a passage is provided with two cylindrical, concentric parts having different diameters, a first part 31, 32 with a smaller diameter and a second part 33, 34 with a larger diameter respectively, which parts are connected to each other by means of a shoulder 35 and 36.

The parts 33 and 34 of the passages with a larger diameter form an axial guide for the slide bearings 17 and 21.

The parts 31 and 32 of the passages with a smaller diameter form an axial guide for a pair of cylindrical pistons, 37 and 38 respectively, which are each provided on a crosscut end of the shafts 16 and 20 and which are coaxially fixed to the shaft 16, 20 concerned by means of the above-mentioned screws 23 with which also the slide bearings 17 and 21 are fixed to the rotors 3 and 4.

Round every piston 37 and 38, in a recess in the bearing plate 30, is provided a sealing 39.

A lid 40 is provided against the bearing plate 30 so as to seal the passages in this bearing plate 30 and so as to form two pressure chambers, 41 and 42 respectively, which are in this case confined by a recess provided in the lid 40 opposite the pistons 37 and 38, by the bearing plate 30 and by the crosscut ends of the pistons 37 and 38 concerned.

Additional pressure chambers 43 and 44 are formed by the spaces confined by the walls of the passages in bearing plate 30, by the crosscut ends of the slide bearings 17 and 21, and by the pistons 37 and 38.

The above-mentioned pressure chambers 41 and 42 are connected to the above-mentioned water circuit 8 via a branch 45, 46, whose pressure is equal or practically equal to the pressure at the outlet of the compressor element 1, whereas the pressure chambers 43 and 44 are connected to the inlet 6 of the screw compressor element 1 via a pipe 47, 48.

Optionally, restrictors 49 and 50 can be provided in the branches 45 and 46 in the form of a constriction of the branch or the like, as well as restrictors 51 and 52 in the pipes 47 and 48.

When the compressor element 1 is operational in an application as a high-pressure compressor element in a multi-stage compressor, the gasses which had already been compressed in a preceding pressure stage will then be drawn in via the inlet 6 and, after further compression, they will be driven out in the compressor element 1 at a higher pressure via the outlet 7.

On the inlet side as well as on the outlet side, compressed gasses under high-pressure are present in this case.

Figure 2:
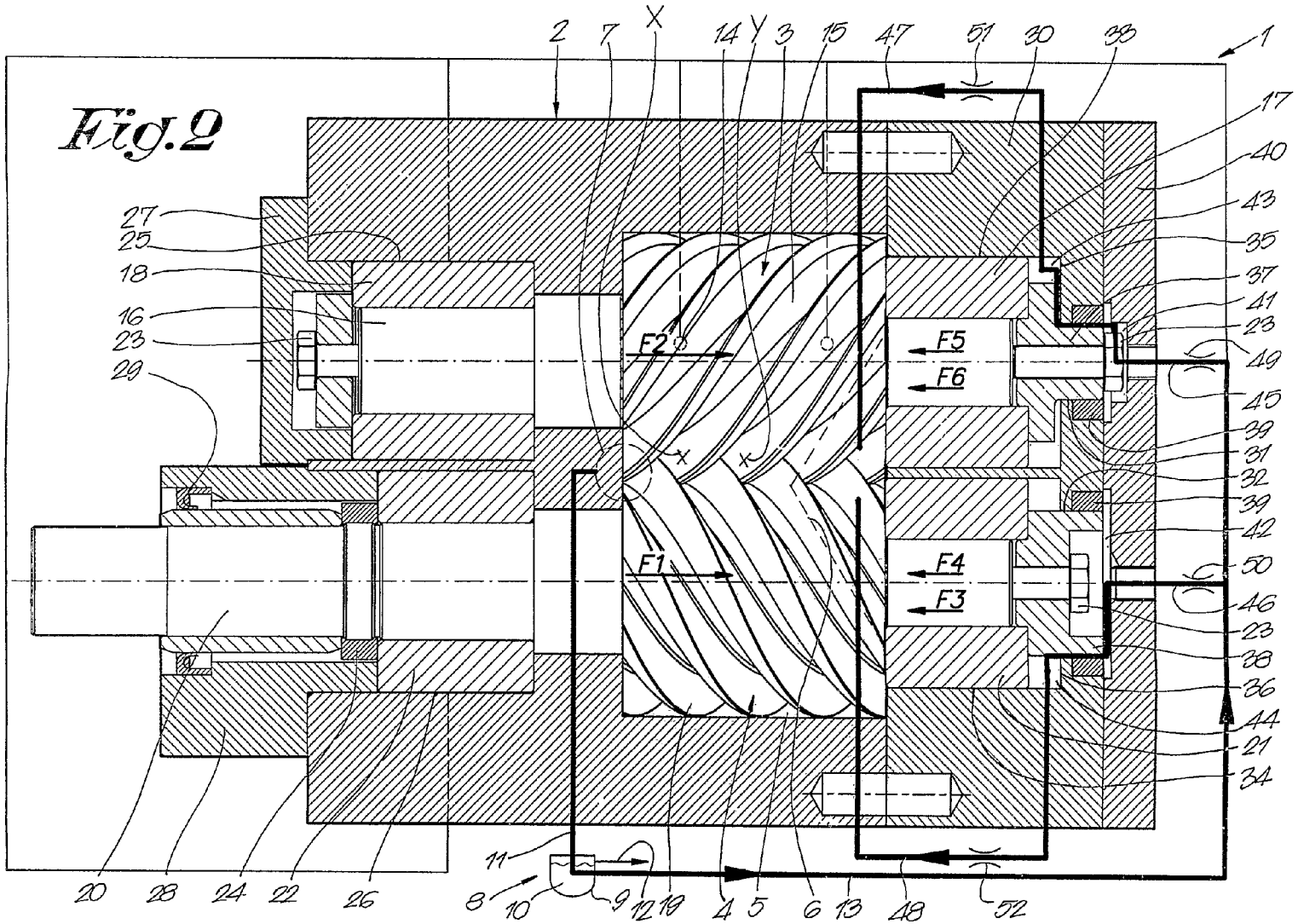
FIG. 2 represents the section of FIG. 1 in which the flow of the water in the screw compressor element is indicated.
Figure 5:
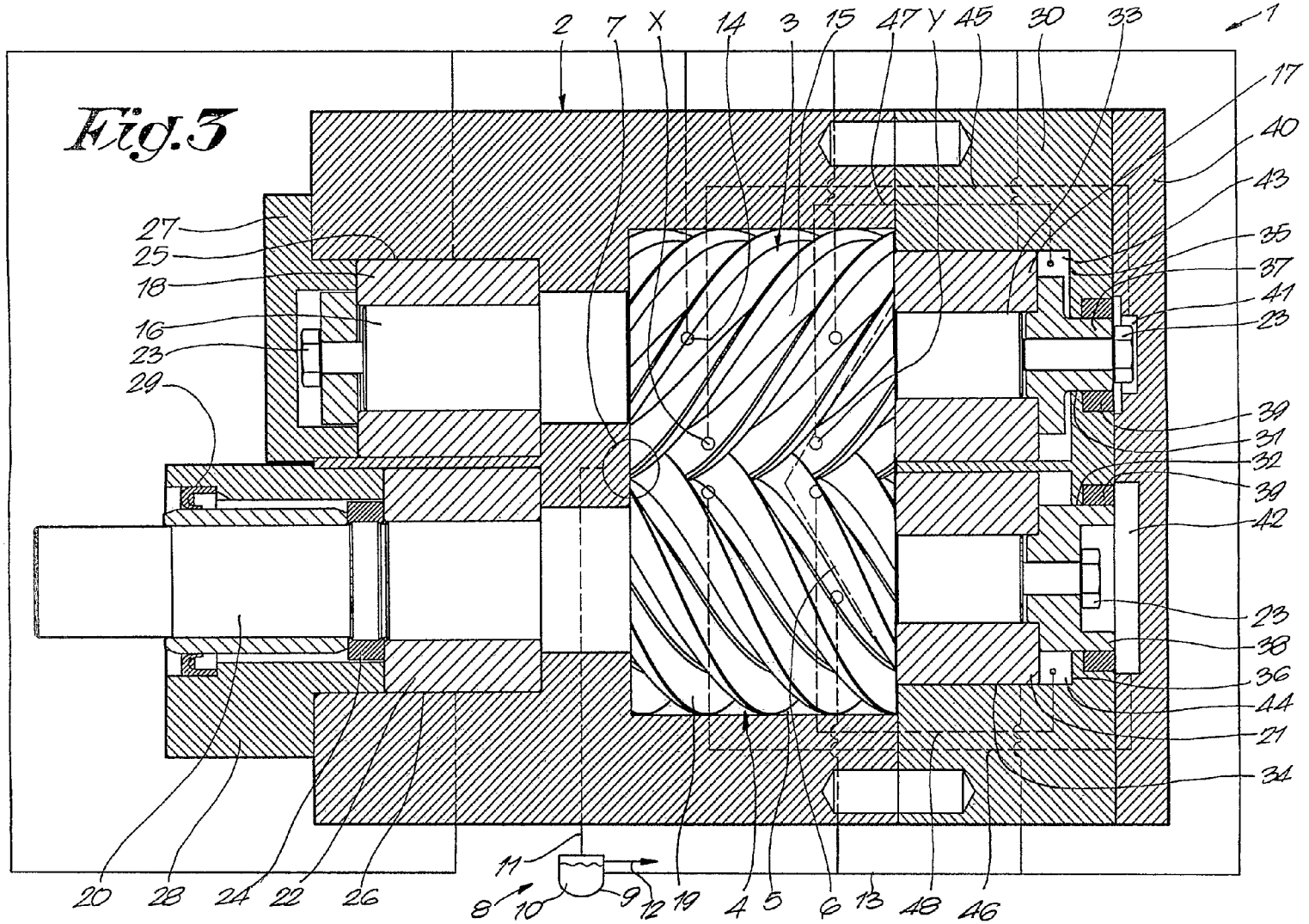

As indicated in FIG. 2, these gasses exert an axial force F2, F1 respectively on the rotor bodies 15 and 19, which forces are directed from the outlet side to the inlet side. The axial gas forces on the female rotor 3 and on the male rotor 4 do not necessarily have to be equal.

Said forces F2 and F1 are the sum of two components, one component of which increases linear to the pressure at the outlet 7 of the screw compressor element 1, whereas the other component increases practically linear to the pressure at the inlet 6.

Thanks to the invention, said forces are compensated for in the following manner.

Via the water circuit 8, water is injected in the rotor chamber 5 for cooling and lubrication, and this water is discharged again from the rotor chamber 5, together with the compressed gas, via the outlet 7 and separated again from the compressed gas in the water separator 9.

As is represented in bold in FIG. 2, a flow of water is created due to the pressure difference between the, inlet 6 and the water circuit 8, whose, pressure is almost equal to the pressure at the outlet 7, which flow of water flows via the branches 45 and 46 in the first pressure chambers 41 and 42 and further via the leaks over the sealings 39 of the first pressure chambers 41 and 42 to the second pressure chambers 43 and 44, to thus flow back to the inlet of the compressor element 1 via the pipes 47 and 48.

The pressure of the water in the pressure chambers 41, 42, 43, 44 depends on the pressure drop over the restrictors 49, 50, 51, 52 which in turn depends on the dimensions of these restrictors and on the flow rate of the water flowing through it.

Depending on what restrictors have been selected, the pressure in the pressure chambers 41 and 42 will always be in proportion to the pressure at the outlet 7 of the compressor element 1 but for a factor, whereas the pressure in the pressure chambers 43 and 44 will be in proportion to the pressure at the inlet 6 but for a factor.

The pressure in the pressure chambers 41, 42 respectively exerts an axial force F5 and F3 on the pistons 37 and 38 and thus also on the rotors 3 and 4 which is directed opposite the gas forces F2 and F1 and which is in proportion to the pressure at the outlet 7 of the compressor element 1.

In the same manner, a pressure force F6 and F4 is exerted on the rotors 3 and 4 by the pressure in the pressure chambers 43, 44 respectively via the slide bearings 17 and 21, such that these slide bearings act as a second set of pistons, so to say, exerting forces F6 and F4 on the rotors 3 and 4 which are directed opposite the gas forces F2 and F1.

By selecting the appropriate restrictors 49, 50, 51, 52 and the appropriate dimensions for the pistons 37 and 38 and of the slide bearings 17 and 21, one can make sure that the gas forces F2 and F1 are entirely or largely neutralized by the forces F3, F4, F5 and F6, as a result of which the axial load of the slide bearings 21 and 22 will be minimal.

This finally favours the life and cost price of the compressor element 1, since smaller slide bearings will do in this case and an additional pump does not necessarily have to be provided for to increase the pressure of the water for a sufficient lubrication of the axial slide bearings.

According to a preferred alternative, no restrictors 49, 50, 51 and 52 are used, and the diameters of the pipes 11, 13, 47, 48 and of the branches 45 and 46 are dimensioned sufficiently large for the pressure losses in these pipes and branches to be minimal, and consequently for the pressure in the pressure chambers 41, 42 to be equal or practically equal to the pressure in the outlet 7, and for the pressure in the pressure chambers 43, 44 to be equal or practically equal to the pressure in the inlet 6.

Use is also made of a sealing 39 with good sealing qualities which lets only a restricted leak flow of water through, such that also the pressure losses over this sealing 39 are minimal.

This is reflected by the fact that pressure ratios between the pressure in the first pressure chambers 41, 42 and the pressure in the outlet 7 and between the pressure in the second pressure chambers 43, 44 and the pressure in the inlet 6 respectively are equal to or almost equal to one.

An advantage of this preferred alternative is that the above-mentioned pressure ratios are always constantly equal to or practically equal to one, irrespective of the load conditions of the screw compressor element.

Thus, by an appropriate selection of the dimensions of the pistons 17, 21, 37, 38, one can make sure that the forces F1 and F2 are entirely or almost entirely compensated for by the forces F3, F4, F5 and F6 exerted on the pistons, irrespective of the operational conditions and the load conditions of the screw compressor element.

If restrictors 49, 50, 51, 52 are applied however, the above-mentioned pressure ratios are not necessarily always constant, and these pressure ratios may vary as a function of the load conditions, so that compensating measures, for example in the form of a pressure regulator, may have to be taken in this case to make surer that the gas forces F1 and F2 are under all circumstances compensated for by the forces F2, F3, F5 and F6 which are in proportion to the pressures in the inlet 6 and the outlet 7 respectively.

It is clear that the pistons 37 and 38 and the pistons which are formed by the slide bearings 17 and 21 can be made according to other embodiments, and that they can even form an integral part of the rotors 3 and 4 or can be integrated in the shafts 16 and 20 of these rotors, whereby the pistons 37 and 38 are formed for example by a far end of the shafts 3 and 4.

By an appropriate selection of the sealings 39, it is even possible to anticipate the leakage flow flowing from the first pressure chambers 41 and 42 to the second pressure chambers 43 and 44. Thus can be realised a suitable leakage connection between the first and the second pressure chambers.

In the given example, this leakage flow is also used to lubricate the hydrodynamic slide bearings 17 and 21, so that these bearings do not need a separate connection to the water circuit 8 in this case.

A part of this leakage flow will then flow back via the slide bearings 17 and 21 from the pressure chambers 43 and 44 to the rotor chamber 5.

A separate water connection for the lubrication of the, bearings is not excluded, however.

The pipes of the water circuit 3, in other words the pipe 13, the branches 45 and 46 and the pipes 47 and 48 can be external, as in the figures, but they can also be realised by means of internal channels, passages and bores in the housing 2.

It is even possible to branch the branches 45 and 46 directly in or in the vicinity of the outlet and consequently not at the water separator. Thus is created an entirely internally controlled double balancing piston.

This makes it possible, for example, instead of branching the pressures for the pressure chambers at the inlet and at the outlet, to branch these pressures at points in the rotor chamber 5 where the pressures are already in proportion to the pressures in the inlet and outlet anyhow.

Such points are indicated for example in FIG. 2 by the references X and Y, and they can be realised for example in the form of a local excavation of the wall of the rotor chamber 5. In this embodiment, the application of restrictors can be avoided.

FIG. 3 represents a compressor element 1 in its most preferred embodiment according to the invention, whereby the first pressure chambers 41 and 42 are fed with water via an entirely internal pipe 45, 46 branched off directly from the rotor chamber 5 as of a point X where the pressure is equal, practically equal or in proportion to the pressure in the outlet 7, whereas the second pressure chambers 43 and 44 are directly connected to the rotor chamber 5 via an entirely internal pipe 47,48 as well, whereby these pipes 47, 48 open into a point Y in the rotor chamber 5 where the pressure is equal, practically equal or in proportion to the pressure in the inlet 6.

In the latter case of FIG. 3, the water circuit 8 for the lubrication of the bearings 17, 18, 21 and 22 is entirely autonomous and separated from the circuit for feeding the pressure chambers 41 to 44.

Figure 4:
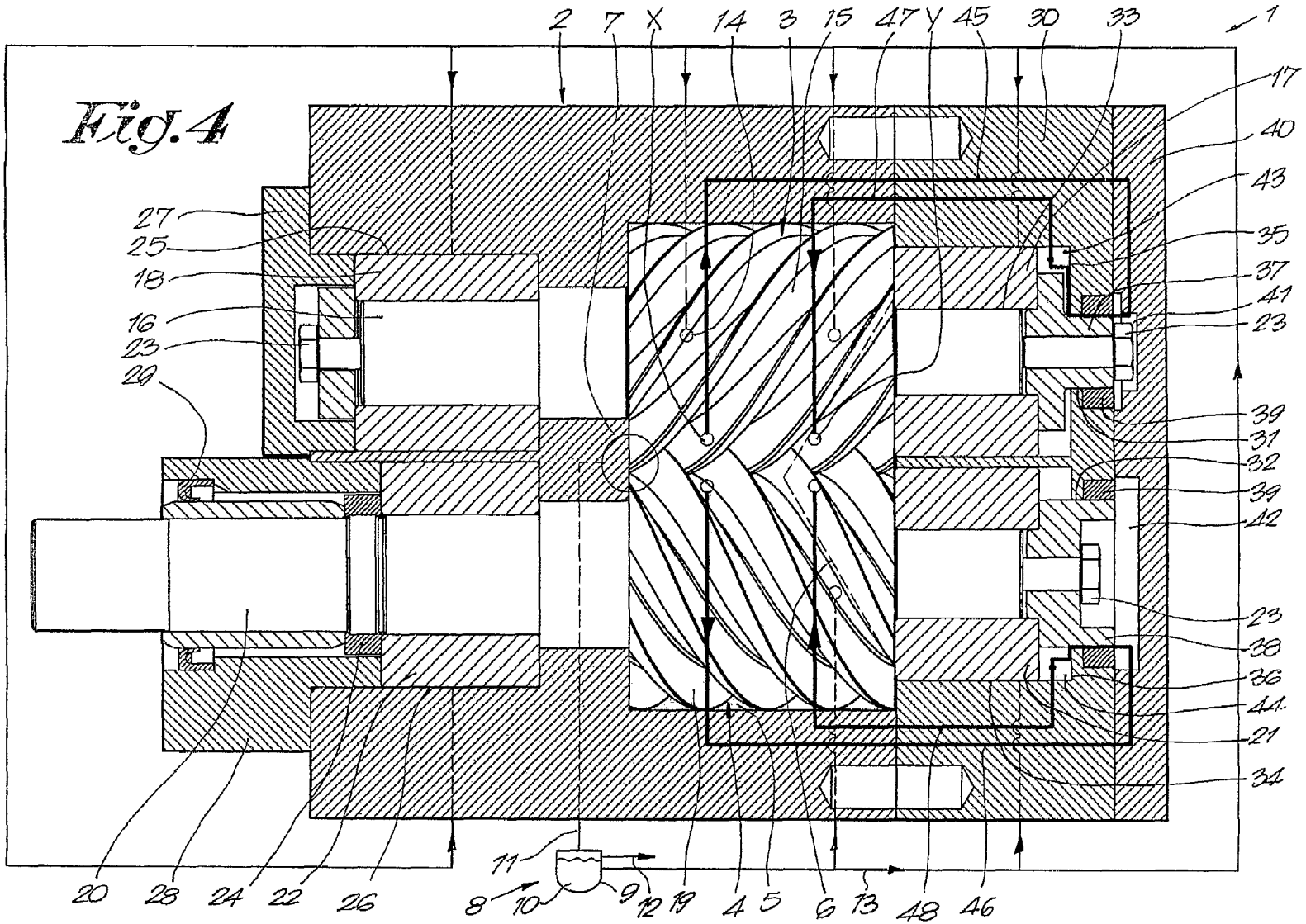
FIG. 4 represents the flow of the water of the variant of FIG. 3.

FIG. 4 represents in bold how the water circulates internally through the pressure chambers 41 to 44.

As the pressure of the water in the water circuit 8, with which the hydrodynamic bearings 17 and 21 are lubricated, is larger than the pressure in the second pressure chambers 43, 44, it is possible to prevent air bells which might be present in the water which is branched off as of the branch point X from the rotor chamber 5, from flowing back to the rotor chamber 5 via the hydrodynamic bearings 17 and 21, which might be detrimental to said bearings.

Of course, it is also possible to feed only the first pressure chambers 41, 42 directly from the rotor chamber 5 via an internal pipe 45, 46, whereas the second pressure chambers 43, 44 are connected to the inlet 6 via a branch 41, 48 as in the embodiment of FIG. 1.

The invention is by no means limited to the embodiments described above and represented in the accompanying figures; on the contrary, such an improved water-injected compressor element can be made in all sorts of variants while still remaining within the scope of the invention.

The invention claimed is:

1. Water-injected screw compressor element comprising:

a housing confining a rotor chamber with an inlet on an inlet side and an outlet on an opposed outlet side and in which first and second co-operating rotors are provided which are mounted in the housing on respective first and second rotor shafts by water-lubricated bearings at first and second ends of each of the first and second rotor shafts;

a water circuit for the injection of water under pressure which opens into the rotor chamber and at the location of said water-lubricated bearings;

at the inlet side of the rotor chamber the first rotor is provided with a first piston and a second piston which can be respectively axially shifted in a first guide and a second guide, and the second rotor is provided with a third piston and a fourth piston which can be respectively axially shifted in a third guide and a fourth guide;

the first piston positioned on the first rotor shaft between a first pressure chamber and a second pressure chamber, the second piston positioned on the first rotor shaft between the second pressure chamber and the first rotor, the third piston positioned on the second rotor shaft between a third pressure chamber and a fourth pressure chamber, the fourth piston positioned on the second rotor shaft between the fourth pressure chamber and the second rotor;

the first and second pressure chambers connected via a first leakage connection, the third and fourth pressure chambers connected via a second leakage connection; and wherein, the first pressure chamber is connected, via a first branch, to the rotor chamber for feeding the first pressure chamber with water that is branched off from the rotor chamber, the second pressure chamber is connected, via a first pipe, to the rotor chamber and fed with water flowing from the first pressure chamber via the first leakage connection, the third pressure chamber is connected, via a second branch, to the rotor chamber for feeding the third pressure chamber with water that is branched off from the rotor chamber, the fourth pressure chamber is connected, via a second pipe, to the rotor chamber and fed with water flowing from the third pressure chamber via the second leakage connection;

wherein the first and third pressure chambers are connected, via the first and second branches, to the rotor chamber and the second and fourth pressure chambers are connected, via the first and second pipes, to the rotor chamber; and wherein axial force components exerted by compressed gasses on the first and second rotors are offset at least in part by pressures within the first, second, third, and fourth pressure chambers acting on the respective first, second, third, and fourth pistons.

2. Water-injected screw compressor element according to claim 1, including a first seal around the first piston sealing the first pressure chamber and forming the first leakage connection to permit a leakage flow of the water flowing between the first and second pressure chambers, and a second seal around the third piston sealing the third pressure chamber and forming the second leakage connection to permit a leakage flow of the water flowing between the third and fourth pressure chambers.

3. Water-injected screw compressor element according to claim 2, wherein the diameters of the first and second branches are sized and the first seal around the first piston and the second seal around the third piston are selected such that the pressure in the first and third pressure chambers is equal to, or practically equal to, a pressure at a point where the first and second branches are branched off from the rotor chamber.

4. Water-injected screw compressor element according to claim 2, wherein the diameters of the first and second pipes are sized and the first seal around the first piston and the second seal around the third piston are selected such that the pressure in the second and fourth pressure chambers is equal to or practically equal to a pressure at a point where the first and second pipes are branched off from the rotor chamber.

5. Water-injected screw compressor element according to claim 1, wherein at least one of the first and second branches and first and second pipes comprise at least one of internal channels, passages and bores in at least one of the housing and a bearing plate.

6. Water-injected screw compressor element according to claim 1, wherein the first and second branches for communicating the pressure of the first and third pressure chambers are branched off directly from the outlet.

7. Water-injected screw compressor element according to claim 1, wherein the first and third pistons are cylindrical and situated in alignment with the respective first and second rotor shafts and are fixed co-axially therewith to the respective first and second rotor shafts.

8. Water-injected screw compressor element according to claim 1, wherein the first piston comprises a far end of the first rotor shaft and the third piston comprises a far end of the second rotor shaft.

9. Water-injected screw compressor element according to claim 1, wherein the second piston comprises the water-lubricated bearing on the first rotor shaft at the inlet side, and the fourth piston comprises the water-lubricated bearing on the second rotor shaft at the inlet side, wherein each of the water-lubricated bearings on the first and second rotor shaft on the inlet side comprise a hydrodynamic radial slide bearing.

10. Water-injected screw compressor element according to claim 9, wherein the hydrodynamic radial slide bearings are ring-shaped slide bearings respectively fixed to and disposed concentrically on the first and second rotor shafts and such that they cannot rotate relative to the respective first and second rotor shafts.

11. Water-injected screw compressor element according to claim 1, wherein the first and second guides and the third and fourth guides are respectively formed by first and second passages in a bearing plate which is arranged to seal the rotor chamber at the inlet side, and wherein the first passage has two concentric parts with different diameters, including a first part which forms the first guide and a second part which forms the second guide of the second piston, wherein the second passage has two concentric parts with different diameters, including a first part which forms the third guide and a second part which forms the fourth guide of the second piston.

12. Water-injected screw compressor element according to claim 11, wherein the first and second passages are sealed by a lid which confines the first and third pressure chambers.

13. Water-injected screw compressor element according to claim 12, wherein the first pressure chamber is formed by a first recess provided in the lid opposite the first passage and the third pressure chamber is formed by second recess provided in the lid opposite the second passage.

14. Water-injected screw compressor element according to claim 11, wherein the second pressure chamber is confined by said first passage in the bearing plate, by the second piston, and by the first piston, and the fourth pressure chamber is confined by said second passage in the bearing plate, by the fourth piston, and by the third piston.

15. Water-injected screw compressor element according to claim 1, wherein a first restrictor is provided in the first branch and a second restrictor is provided in the second branch.

16. Water-injected screw compressor element according to claim 1, wherein a first restrictor is provided in the first pipe and a second restrictor is provided in the second pipe.

17. Water-injected screw compressor element according to claim 1, wherein the first and third pressure chambers are connected, via the first and second branches, to the rotor chamber at a point where the pressure is equal to, or practically equal to, a pressure at the outlet of the rotor chamber, and the second and fourth pressure chambers are connected, via the first and second pipes, to the rotor chamber at a pressure which is equal to, or practically equal to, a pressure at the inlet of the rotor chamber.

18. Water-injected screw compressor element according to claim 1, wherein the first and third pressure chambers are connected, via the first and second branches, to the rotor chamber at a point where the pressure is in proportion to a pressure at the outlet of the rotor chamber, and the second and fourth pressure chambers are connected, via the first and second pipes, to the rotor chamber at a pressure which is in proportion to a pressure at the inlet of the rotor chamber.

* * * * *